US008904596B1

(12) United States Patent
Perry et al.

(10) Patent No.: US 8,904,596 B1
(45) Date of Patent: Dec. 9, 2014

(54) OIL SPILL VACUUM HOSE SUPPORT

(71) Applicants: Leslie G. Perry, Stratford, OK (US); Tina S. Perry, Stratford, OK (US)

(72) Inventors: Leslie G. Perry, Stratford, OK (US); Tina S. Perry, Stratford, OK (US)

( * ) Notice: Subject to any disclaimer, the term of this patent is extended or adjusted under 35 U.S.C. 154(b) by 92 days.

(21) Appl. No.: 13/866,340

(22) Filed: Apr. 19, 2013

(51) Int. Cl.
*A47L 7/00* (2006.01)
*A47L 9/02* (2006.01)
*A47L 9/24* (2006.01)

(52) U.S. Cl.
CPC ..... *A47L 9/248* (2013.01)
USPC ..... 15/415.1; 15/322

(58) Field of Classification Search
USPC ..... 15/320, 322, 340.2, 415.1
IPC ..... A47L 7/00,9/02
See application file for complete search history.

(56) References Cited

U.S. PATENT DOCUMENTS

| | | | | |
|---|---|---|---|---|
| 4,068,824 | A | 1/1978 | Flynn | |
| 4,395,794 | A * | 8/1983 | Duncan | 15/420 |
| 4,492,001 | A | 1/1985 | Hedrenius | |
| 5,293,887 | A * | 3/1994 | Thibodeaux | 134/24 |
| 5,302,210 | A * | 4/1994 | Whyte | 134/25.1 |
| 5,481,779 | A | 1/1996 | Flynn et al. | |
| 5,839,157 | A * | 11/1998 | Strauser et al. | 15/347 |

* cited by examiner

*Primary Examiner* — David Redding
(74) *Attorney, Agent, or Firm* — Crossley Patent Law

(57) ABSTRACT

An oil spill vacuum hose support including an S-shaped vacuum wand having a top end and a bottom end, an internal hose disposed therewithin, and a threaded hose connection attached to an upper end of the internal hose and disposed within a grip on the top end. The hose connection connects the internal hose to an industrial oil spill vacuum hose. A housing, disposed on the bottom end, houses a vacuum head attached to the internal hose terminus to suction up an oil spill. The housing is disposed between a pair of concave guidance skis which support the housing in an upright position and assist with guiding and supporting the vacuum wand. Each guidance ski includes a concave base member and a brace member. A handle is disposed on the vacuum wand to permit a user to maintain a firm grip while guiding the device.

6 Claims, 4 Drawing Sheets

OIL SPILL VACUUM HOSE SUPPORT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Figure 1:
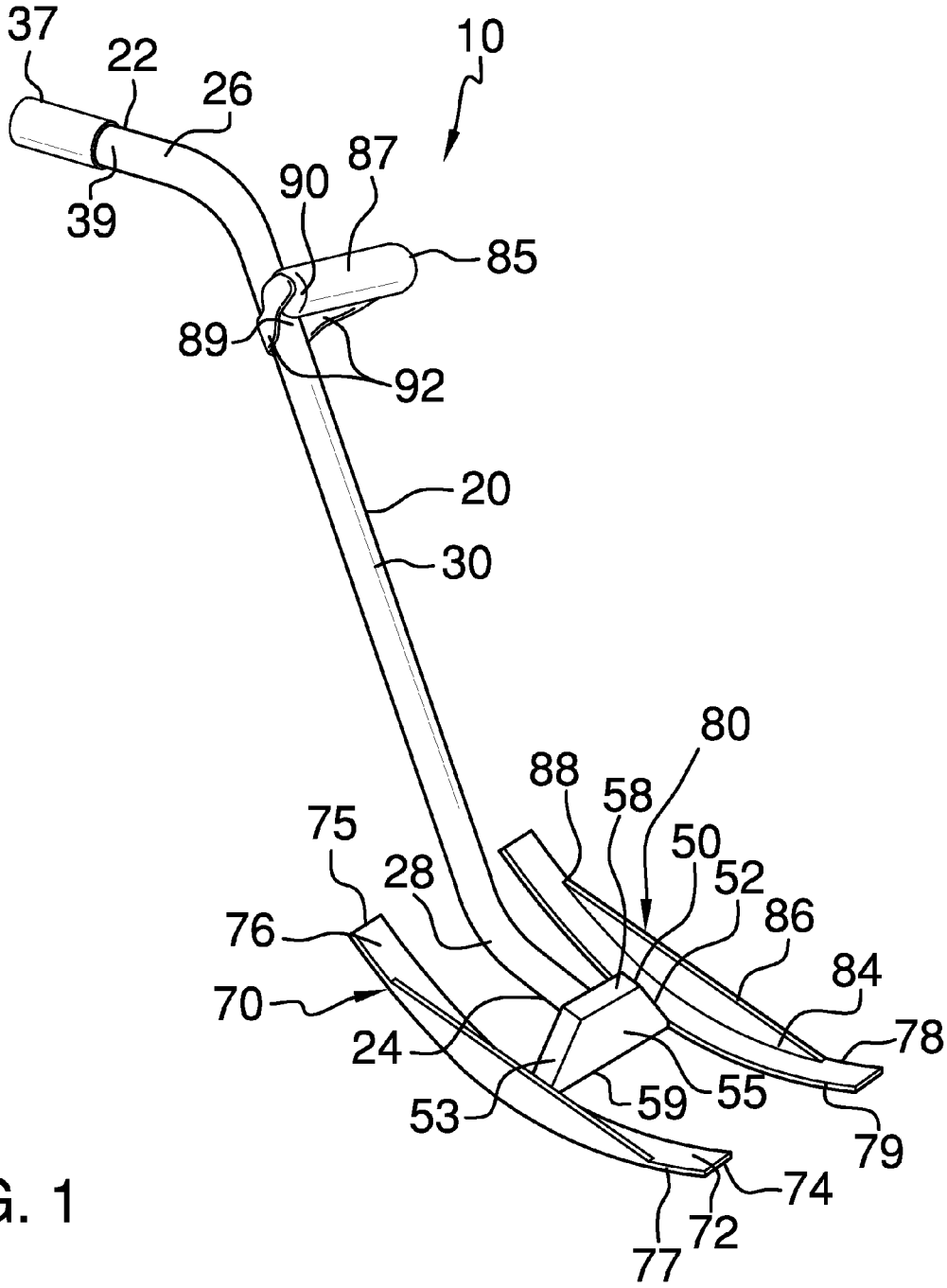

Various types of industrial vacuum cleaners and accessories therefore are known in the prior art. These devices suffer from disadvantages, including insufficient lifting torque. What is needed is an oil spill vacuum hose support to assist in the cleanup of an industrial oil spill with that overcomes the aforementioned problem and which eliminates the need to bend over while holding the oil spill vacuum hose over the user's shoulder by including a vacuum wand having a top end and a bottom end, an internal hose disposed therewithin, and a threaded hose connection, which connects the internal hose to an industrial oil spill vacuum hose, attached to an upper end of the internal hose and disposed within a grip on the top end. A housing, disposed on the bottom end, houses a vacuum head attached to the internal hose terminus. The housing is disposed between a pair of concave guidance skis which support the housing in an upright position and assist with guiding and supporting the vacuum wand. Each guidance ski includes a concave base member and a brace member. A handle is disposed on the vacuum wand to permit a user to maintain a firm grip while guiding the device

FIELD OF THE INVENTION

The present invention relates to industrial vacuum cleaners, and more particularly, to an oil spill vacuum hose support which includes a vacuum wand having a grip and threaded hose connection disposed in the grip on a top end, a handle in a center section of the wand, and a housing that houses a vacuum head and which is disposed between a pair of guidance skis.

SUMMARY OF THE INVENTION

The general purpose of the present oil spill vacuum hose support, described subsequently in greater detail, is to provide an oil spill vacuum hose support which has many novel features that result in an oil spill vacuum hose support which is not anticipated, rendered obvious, suggested, or even implied by prior art, either alone or in combination thereof.

To accomplish this, the present oil spill vacuum hose support includes a vacuum wand and an internal hose disposed within the entire length of the vacuum wand. A grip is disposed on a top end of the vacuum wand. A threaded hose connection is attached to an upper end of the internal hose and is disposed within the grip. The hose connection is configured to connect the internal hose to an industrial oil spill vacuum hose. A housing is disposed on the bottom end. A vacuum head, that attaches to the terminus of the internal hose and operationally engages the internal hose, is disposed within the housing. The vacuum head is configured to suction up an amount of oil from an oil spill when the internal hose is operationally engaged with an activated industrial oil spill vacuum hose.

A concave guidance ski is disposed on each of a right side and the left side of the housing in a position parallel to each other and substantially perpendicular to the housing. The housing is centrally disposed between the guidance skis. The guidance skis are configured to support the housing in an upright position and also to assist with guiding and supporting the vacuum wand. Each guidance ski includes a concave base member having a forward end, a rearward end, an upper side, a lower side, an outer side, and an inner side. Each guidance ski further includes a brace member centrally disposed between the forward end and the rearward end on the upper side. The brace member has a convex bottom wall disposed on the upper side along the outer side and a top wall extending from each of an outside edge of the bottom wall. The convex bottom wall conforms to the concave upper side of the base member. Each of the right side and left side of the housing are attached to the respective inner side of the base member. A handle is disposed on the vacuum wand to permit a user to maintain a firm grip while guiding the device.

The present device is structurally designed to support and guide the vacuum wand and internal hose attached to an industrial oil spill vacuum hose by using the handle and the grip to maintain firm control over the device while guiding the guidance skis to directly the internal hose to suction up oil from an oil spill. The instant device eliminates the need for a user to bend over while holding an oil spill vacuum hose over the user's shoulders. Thus, the device avoids back strain. The device also saves the user time and effort that is often expended in properly handling the oil spill vacuum hose.

Thus has been broadly outlined the more important features of the present oil spill vacuum hose support so that the detailed description thereof that follows may be better understood and in order that the present contribution to the art may be better appreciated.

BRIEF DESCRIPTION OF THE DRAWINGS FIGURES

Figure 2:
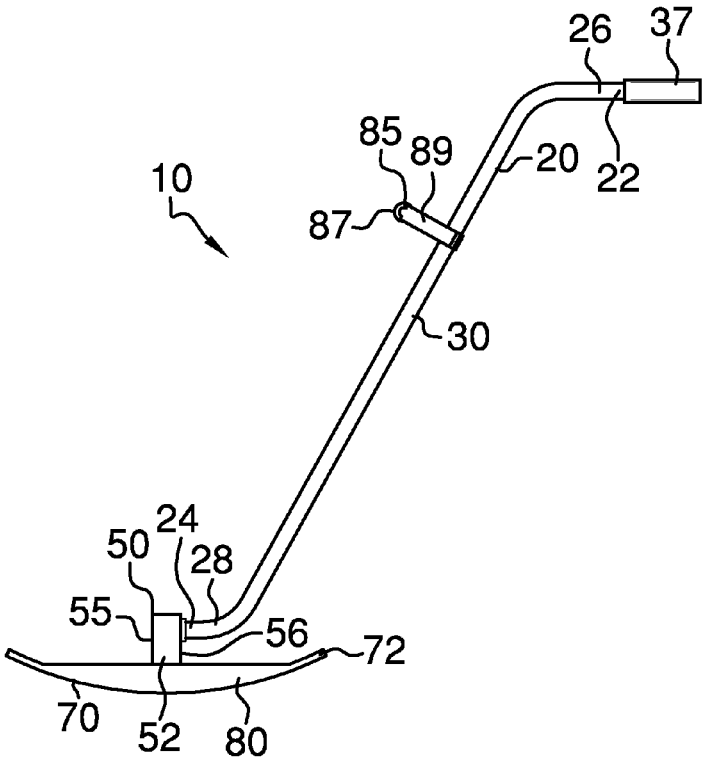
Figure 3:
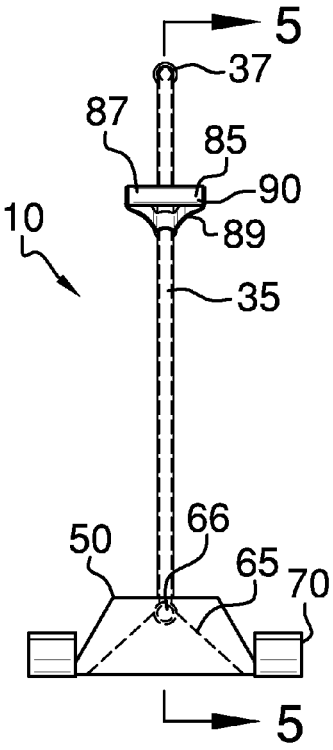
Figure 4:
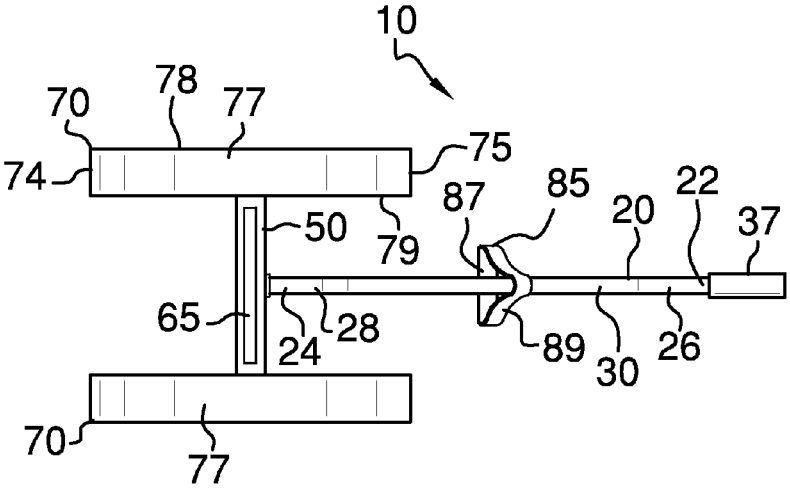
Figure 5:
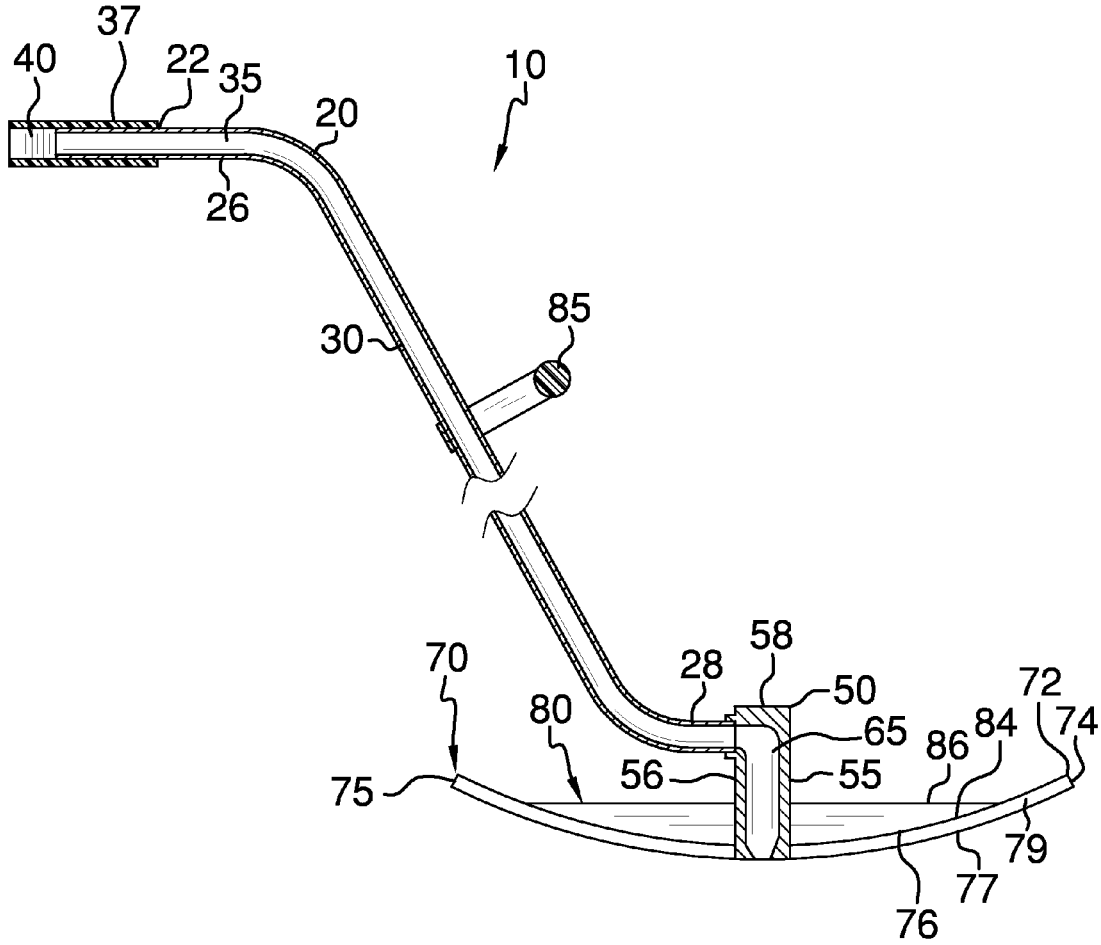
Figure 6:
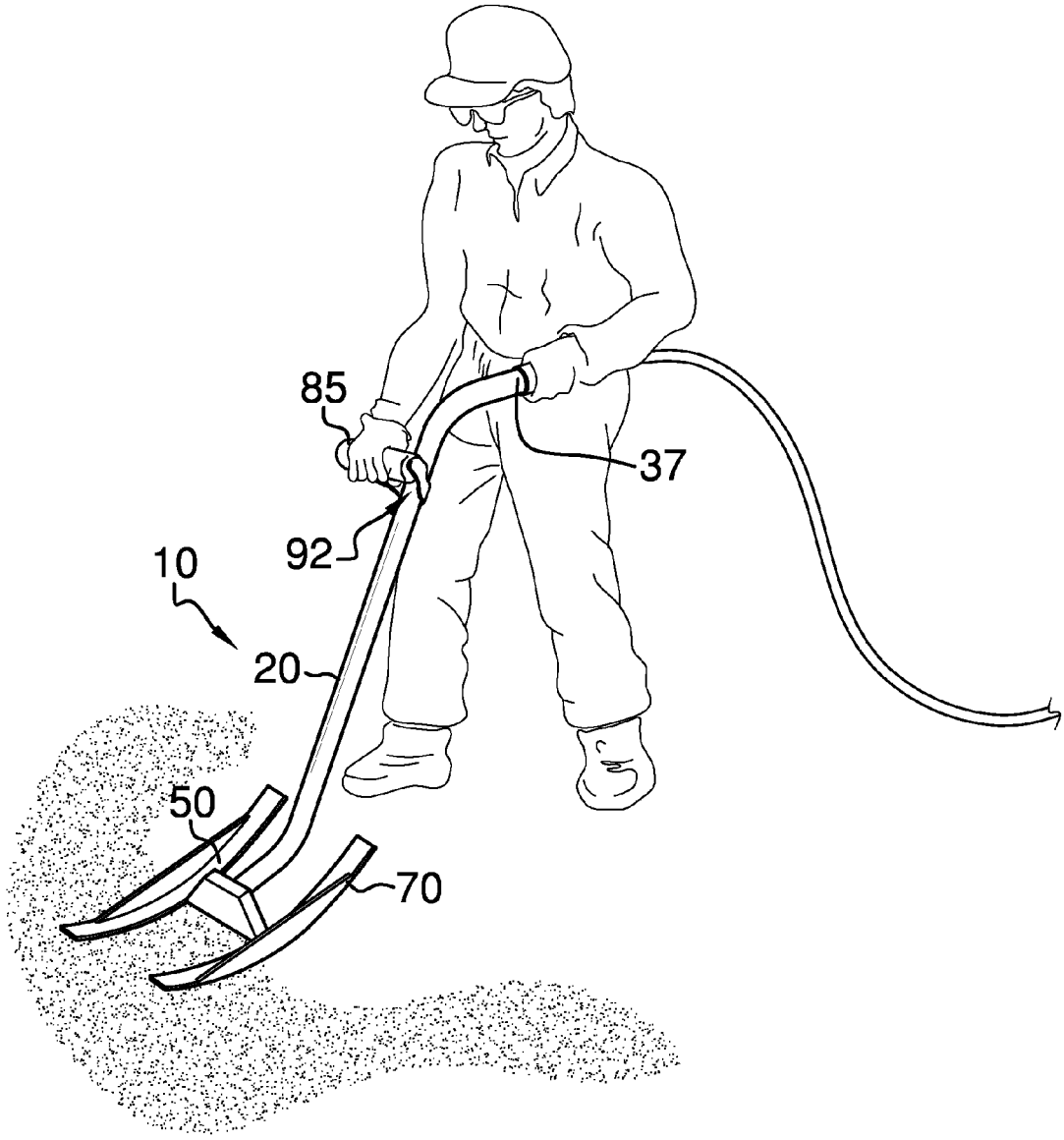

FIG. 1 is an isometric view.
FIG. 2 is a side elevation view.
FIG. 3 is a front elevation view.
FIG. 4 is a bottom plan view.
FIG. 5 is a cross-sectional view taken along line 5-5 of FIG. 3.
FIG. 6 is an isometric in-use view.

DETAILED DESCRIPTION OF THE DRAWINGS

With reference now to the drawings, and in particular FIGS. 1 through 6 thereof, example of the instant oil spill vacuum hose support employing the principles and concepts of the present oil spill vacuum hose support and generally designated by the reference number 10 will be described.

Referring to FIGS. 1 through 6 a preferred embodiment of the present oil spill vacuum hose support 10 is illustrated. The oil spill vacuum hose support 10 includes a cylindrical vacuum wand 20 having a top end 22 and a bottom end 24. The vacuum wand 20 is S-shaped and has a top portion 26 proximal the top end 22, a bottom portion 28 proximal the bottom end 24, and an elongated center portion 30 disposed between the top portion 26 and the bottom portion 28. The S-shape of the vacuum wand 20 and the elongated center portion 30 provide an ergonomic structure that functions to prevent back strain by eliminating the need to bend over while holding an oil spill vacuum hose over a user's shoulder.

An internal hose 35 is disposed within the entire length of the vacuum wand 20. A grip 37 is disposed on the top end 22. The grip 37 is cylindrical and surrounds an outer perimeter 39 of the top end 22. A threaded hose connection 40 is attached to an upper end 42 of the internal hose 35. The hose connection 40 is disposed within the grip 37. The hose connection 40 is configured to connect the internal hose 35 to an industrial oil spill vacuum hose (not shown).

A housing 50 is disposed on the bottom end 24. The housing 50 has a rectangular right side 52 and a rectangular left side 53. The housing 50 also has a pentagonal forward wall 55, a pentagonal rearward wall 56, a rectangular upper wall 58, a rectangular lower wall 59. The upper wall 58 has an area smaller than the lower wall 59. A vacuum head 65 is disposed within the housing 50. The vacuum head 65 operationally engages the internal hose 35. The vacuum head 65 is attached to the terminus 66 of the internal hose 35 and is configured to suction up an amount of oil from an oil spill when the internal hose 35 is operationally engaged with an activated industrial oil spill vacuum hose.

A concave guidance ski 70 is disposed on each of the right side 52 and the left side 53 of the housing 50. The guidance skis 70 are parallel to each other and substantially perpendicular to each of the forward wall 55 and the rearward wall 56 of the housing 50. The housing 50 is centrally disposed between the guidance skis 70. The guidance skis 70 are configured to support the housing 50 in an upright position and also to assist with guiding and supporting the vacuum wand 20. Each guidance ski 70 includes a concave base member 72 having a forward end 74, a rearward end 75, an upper side 76, a lower side 77, an outer side 78, and an inner side 79. Each guidance ski 70 further includes a brace member 80 centrally disposed between the forward end 74 and the rearward end 75 on the upper side 76. The brace member 80 has a convex bottom wall 84 disposed on the upper side 76 along the outer side 78 of the brace member 80 and a top wall 86 extending from each of an outside edge 88 of the bottom wall 84. The convex bottom wall 84 conforms to the concave upper side 76 of the base member 72. Each of the right side and the left side 52, 53 of the housing 50 are attached to the respective inner side 79 of the base member 62.

A handle 85 is disposed on the vacuum wand 20 in a position more proximal the top end 22 than the bottom end 24 to eliminate the need to bend over while handling and guiding the vacuum wand 20 and guidance skis 70. The handle 85 is disposed on the center portion 30 of the vacuum wand 20 proximal the top portion 26. The handle 85 has a grip portion 87 disposed perpendicular to the center portion 30 of the vacuum wand 20. The handle 85 also has a support leg 89 disposed between each of an outside end 90 of the grip portion 87 and the vacuum wand 20 center portion 30. An opening 92 is disposed between the handle 85 and the vacuum wand 20 to permit a user to firmly grip the handle 85.

What is claimed is:

1. An oil spill vacuum hose support comprising:

a cylindrical vacuum wand having a top end and a bottom end;

an internal hose disposed within the entire length of the vacuum wand;

a grip disposed on the top end;

a threaded hose connection attached to an upper end of the internal hose, wherein the hose connection is configured to connect the internal hose to an industrial oil spill vacuum hose;

a housing disposed on the bottom end, wherein the housing has a right side and a left side;

a vacuum head disposed within the housing, wherein the vacuum head operationally engages the internal hose, wherein the vacuum head is disposed at the terminus of the internal hose and is configured to suction up an amount of oil from an oil spill when the internal hose is operationally engaged with an activated industrial oil spill vacuum hose; and a concave guidance ski disposed on each of the right side and the left side of the housing in a position parallel to each other and substantially perpendicular to each of a forward wall and a rearward wall of the housing, wherein the housing is centrally disposed between the guidance skis, wherein the guidance skis are configured to support the housing in an upright position.

2. The oil spill vacuum hose support of claim 1 wherein the vacuum wand is S-shaped and has a top portion proximal the top end, a bottom portion proximal the bottom end, and an elongated center portion disposed between the top portion and the bottom portion;

wherein each guidance ski comprises:

a concave base member having a forward end, a rearward end, an upper side, a lower side, an outer side, and an inner side; and a brace member centrally disposed between the forward end and the rearward end on the upper side, the brace member having a convex bottom wall disposed on the upper side along the outer side and a top wall extending from each of an outside edge of the bottom wall.

3. The oil spill vacuum hose support of claim 2 wherein the housing further has a pentagonal forward wall, a pentagonal rearward wall, a rectangular upper wall, a rectangular lower wall;

wherein the upper wall has an area smaller than the lower wall;

wherein each of the right side and the left side are rectangular; and wherein each of the right side and the left side are attached to the respective inner side of the base member.

4. The oil spill vacuum hose support of claim 3 further comprising a handle disposed on the vacuum wand in a position more proximal the top end than the bottom end;

wherein the handle is disposed on the center portion of the vacuum wand proximal the top portion;

wherein the handle has a grip portion disposed perpendicular to the center portion of the vacuum wand, a support leg disposed between each of an outside end of the grip portion and the vacuum wand center portion; and wherein an opening is disposed between the handle and the vacuum wand.

5. The oil spill vacuum hose support of claim 4 wherein the grip is cylindrical and surrounds an outer perimeter of the top end.

6. An oil spill vacuum hose support comprising:

a cylindrical vacuum wand having a top end and a bottom end;

an internal hose disposed within the entire length of the vacuum wand;

a grip disposed on the top end;

a threaded hose connection attached to an upper end of the internal hose, the threaded hose connection disposed within the grip, wherein the hose connection is configured to connect the internal hose to an industrial oil spill vacuum hose;

a housing disposed on the bottom end, wherein the housing has a rectangular right side and a rectangular left side;

a vacuum head disposed within the housing, wherein the vacuum head operationally engages the internal hose, wherein the vacuum head is disposed at the terminus of the internal hose and is configured to suction up an amount of oil from an oil spill when the internal hose is operationally engaged with an activated industrial oil spill vacuum hose;

a concave guidance ski disposed on each of the right side and the left side of the housing, wherein the guidance skis are parallel to each other and substantially perpendicular to each of a forward wall and a rearward wall of the housing, wherein the housing is centrally disposed between the guidance skis, wherein the guidance skis are configured to support the housing in an upright position;

a handle disposed on the vacuum wand in a position more proximal the top end than the bottom end;

wherein the vacuum wand is S-shaped and has a top portion proximal the top end, a bottom portion proximal the bottom end, and an elongated center portion disposed between the top portion and the bottom portion;

wherein each guidance ski comprises:

a concave base member having a forward end, a rearward end, an upper side, a lower side, an outer side, and an inner side; and a brace member centrally disposed between the forward end and the rearward end on the upper side, the brace member having a convex bottom wall disposed on the upper side along the outer side and a top wall extending from each of an outside edge of the bottom wall;

wherein the housing further has a pentagonal forward wall, a pentagonal rearward wall, a rectangular upper wall, a rectangular lower wall;

wherein the upper wall has an area smaller than the lower wall;

wherein each of the right side and the left side are attached to the respective inner side of the base member;

wherein the handle is disposed on the center portion of the vacuum wand proximal the top portion;

wherein the handle has a grip portion disposed perpendicular to the center portion of the vacuum wand, a support leg disposed between each of an outside end of the grip portion and the vacuum wand center portion;

wherein an opening is disposed between the handle and the vacuum wand; and wherein the grip is cylindrical and surrounds an outer perimeter of the top end.

* * * * *